US010611387B2

(12) United States Patent
Bonney et al.

(10) Patent No.: US 10,611,387 B2
(45) Date of Patent: Apr. 7, 2020

(54) DRAFT AND BUFFER APPARATUS

(71) Applicant: Voith Patent GmbH, Heidenheim (DE)

(72) Inventors: Bernhard Bonney, Braunschweig (DE); Martin Schueler, Wermelskirchen (DE)

(73) Assignee: Voith Patent GmbH, Heidenheim (DE)

( * ) Notice: Subject to any disclaimer, the term of this patent is extended or adjusted under 35 U.S.C. 154(b) by 222 days.

(21) Appl. No.: 15/439,265

(22) Filed: Feb. 22, 2017

(65) Prior Publication Data

US 2017/0158211 A1 Jun. 8, 2017

Related U.S. Application Data

(63) Continuation of application No. PCT/EP2015/068164, filed on Aug. 6, 2015.

(30) Foreign Application Priority Data

Aug. 22, 2014 (DE) ..... 10 2014 216 719
Apr. 29, 2015 (DE) ..... 10 2015 207 849

(51) Int. Cl.
*B61G 11/16* (2006.01)
*B61G 9/04* (2006.01)
(Continued)

(52) U.S. Cl.
CPC ..... *B61G 11/16* (2013.01); *B61G 9/04* (2013.01); *B61G 9/06* (2013.01); *B61G 11/00* (2013.01)

(58) Field of Classification Search
CPC ..... B61G 11/00; B61G 11/08; B61G 11/10; B61G 11/18; B61G 11/16; B61G 9/04;
(Continued)

(56) References Cited

U.S. PATENT DOCUMENTS 3,246,771 A 4/1966 Gray
6,681,943 B2 1/2004 Barker et al.
(Continued)

FOREIGN PATENT DOCUMENTS

DE 2949677 A1 6/1981
DE 202005004502 U1 5/2005
(Continued)

OTHER PUBLICATIONS

International Search Report of the international searching authority dated Nov. 4, 2015 in international patent application PCT/EP2015/068164 on which the claim of priority is based.

*Primary Examiner* — Mark T Le
(74) *Attorney, Agent, or Firm* — Walter Ottesen, P.A.

(57) ABSTRACT

A draft and buffer apparatus for a track-guided vehicle includes a coupling rod and a draft yoke for connecting the coupling rod to the vehicle body. An energy-dissipating device is arranged between the vehicle and the coupling rod for receiving draft and buffer forces. The energy-dissipating device includes a reversible energy-dissipating unit and is configured so as to cause the force flow of the buffer loads transmitted thereto from the coupling rod and of the draft loads transmitted via the draft yoke thereto to be conducted through the energy-dissipating device and to be transmitted to the vehicle body. The energy-dissipating device further includes an irreversible energy-dissipating unit providing irreversible energy dissipation. The energy-dissipation device is mounted within the axial extent of the draft yoke when viewed in the longitudinal direction of the vehicle.

32 Claims, 3 Drawing Sheets

(51) Int. Cl.
*B61G 9/06* (2006.01)
*B61G 11/00* (2006.01)

(58) Field of Classification Search
CPC .... B61G 9/06; B61G 9/24; F16F 7/125; F16F 7/12; B60R 19/34; B60R 19/36
See application file for complete search history.

(56) References Cited

U.S. PATENT DOCUMENTS

| | | | | |
|---|---|---|---|---|
| 6,796,448 | B1 * | 9/2004 | Wilt | B61G 7/10 213/40 R |
| 2009/0039044 | A1 * | 2/2009 | Krause | B61G 9/24 213/64 |
| 2012/0031299 | A1 * | 2/2012 | Kontetzki | B60R 19/34 105/392.5 |

FOREIGN PATENT DOCUMENTS

| | | | |
|---|---|---|---|
| EP | 1468889 | A1 | 10/2004 |
| EP | 1785330 | A1 | 5/2007 |
| EP | 2072370 | A1 | 6/2009 |
| EP | 2335996 | A1 | 6/2011 |
| WO | WO 2012/166073 | * | 12/2012 |

* cited by examiner

DRAFT AND BUFFER APPARATUS

CROSS REFERENCE TO RELATED APPLICATIONS

This application is a continuation application of international patent application PCT/EP2015/068164, filed Aug. 6, 2015, designating the United States and claiming priority from German applications 10 2014 216 719.1, filed Aug. 22, 2014 and 10 2015 207 849.3, filed Apr. 29, 2015, and the entire content of all of the above applications is incorporated herein by reference.

FIELD OF THE INVENTION

The invention relates to a draft and buffer apparatus. The invention furthermore relates to an energy-dissipating device for integration in such a draft and buffer apparatus.

BACKGROUND OF THE INVENTION

EP 2 335 996 B1 discloses a central buffer coupling with a coupling rod which is of at least two-part configuration and is fastened to the coach body via a draft yoke, wherein the rear coupling rod portion is connected to the coach body so as to be displaceable in the longitudinal direction relative to the draft yoke. At least one energy-dissipating device is arranged between the rear coupling rod portion and the coach body, for example in the form of a spring apparatus or else in the form of a deformation tube which responds after a critical impact force introduced into the energy-dissipating element is exceeded, and, by means of plastic deformation, dissipates some of the impact energy introduced into the energy-dissipating element, and is configured in order to at least partially dissipate in the impact energy which occurs in the event of a crash or in the normal traveling mode and is transmitted from the coupling rod to the coach body, that is to convert the impact energy into plastic deformation work and heat or to absorb same. The configuration is undertaken depending on the magnitude of the forces which occur. For very high energy dissipation, a corresponding configuration of the energy-dissipating devices is required, with this being reflected in an increased requirement for construction space.

Furthermore, draft yoke systems with integrated preliminary damping and reversible energy dissipation are known in the form of pretensioned spring units as disclosed, for example, in U.S. Pat. No. 6,681,943 B2.

EP 1 468 889 B1 has previously disclosed a rail vehicle with a coupling linkage and a rubber damper, which is coupled to the body of the coupling by a connecting bolt, and comprises an irreversible energy-absorbing element which is tubular and has a rectangular cross section over its entire length, wherein the rubber damper arrangement and the irreversible energy-absorbing element are arranged in series in the longitudinal direction of a vehicle body of the vehicle. The vehicle body frame is configured to absorb a collision load in the longitudinal direction of the vehicle body that is transmitted via the energy-absorbing element. For this purpose, the rubber damper is held in a supporting frame which is attached to the vehicle body frame.

The draft and buffer apparatus, which is fastened by flange-mounting on an underframe of a rail vehicle and has draft- and buffer-side energy-dissipating units arranged in a single housing, is disclosed in DE 20 2005 004 502 U1. Buffer-side and draft-side energy-dissipating systems are connected in series in a housing, wherein one of the two comprises a deformation element.

SUMMARY OF THE INVENTION

Starting from the systems described above, it is an object of the invention to provide a coupling linkage of the type referred to above, especially a coupling linkage via draft yokes, as customary for SA-3 couplings or AAR couplings, to the effect that, for the transmission of draft and buffer forces from the draft bar, a high energy dissipation can be incorporated in the available construction space without considerable additional modifications. The solution according to the invention is intended to be distinguished herein by a relatively simple assembly.

A draft and buffer apparatus configured according to the invention is for a track-guided vehicle, especially a rail vehicle, comprising a coupling rod, which is connected to a vehicle body of a vehicle via a draft yoke, for transmitting draft forces, which occur in the traveling mode, from the coupling rod to the vehicle body (in particular to the vehicle body from the coupling rod via a spring apparatus, on the one hand, and via the coupling rod directly via the spring apparatus, on the other hand), comprising an energy-dissipating device which is arranged between the vehicle-body-side end region of the coupling rod and the vehicle body and has a reversible energy-dissipating unit (in particular comprising a spring apparatus having an energy-dissipating device which is arranged between the vehicle-body-side end region of the coupling rod and the vehicle body and has a reversible energy-dissipating unit), wherein the energy-dissipating device is configured in such a manner that the force flow of the buffer or impact forces transmitted from the coupling rod directly thereto and the force flow of the draft forces transmitted via the draft yoke is conducted through the energy-dissipating apparatus (in particular that the force flow of the draft forces transmitted from the coupling rod to the draft yoke and of the buffer forces introduced via the rod directly via the spring apparatus is conducted through the energy-dissipating device) and is transmitted to the vehicle body via stop regions for the introduction of draft forces and/or buffer forces to the vehicle body or to a component which is connected at least indirectly thereto, the energy-dissipating device or the spring apparatus in the fitted position having, as viewed in the longitudinal direction of the coupling rod, a front transmission element on the vehicle side and a rear transmission element on the vehicle side, between which the reversible energy-dissipating unit is arranged in a pretensioned manner, comprises the fact that the energy-dissipating device furthermore comprises an energy-dissipating unit with irreversible energy dissipation, and the energy-dissipating device is arranged within the axial extent of the draft yoke, as viewed in the longitudinal direction of the vehicle.

The solution according to the invention therefore combines the advantages of reversible and irreversible energy dissipation in a minimal construction space for a draft and buffer apparatus while maintaining existing fitting conditions and permits simple retrofitting in systems which already exist.

There is basically the possibility—depending on the desired conduction of force—to connect the individual energy-dissipating devices, especially a reversible energy-dissipating unit and an energy-dissipating unit with irreversible energy dissipation in series or in parallel. According to a particularly advantageous embodiment which can be realized structurally with little complexity, the reversible energy-dissipating unit and the energy-dissipating unit with irreversible energy dissipation are connected in series, wherein the energy-dissipating unit with irreversible energy dissipation is irreversibly deformed and/or destroyed when a predefined maximum draft/buffer force is exceeded. That is, the force flow takes place successively here via the individual energy-dissipating units. Each of the energy-dissipating units can be configured here with respect to its area of use.

In a further embodiment, a shearing unit is provided between the reversible energy-dissipating unit and the energy-dissipating unit with irreversible energy dissipation. The shearing unit is configured and arranged in such a manner as to respond when a maximally permissible draft/buffer force is exceeded and to permit a destructive effect on the energy-dissipating unit with irreversible energy dissipation. This solution affords the advantage of a defined determination of the required shearing force.

A simple construction and simple installation are provided here for embodiments in which the energy-dissipating unit with irreversible energy dissipation and the reversible energy-dissipating unit are at least partially, preferably completely, arranged next to each other or arranged one downstream of the other, as viewed in the longitudinal direction of the vehicle. Here, the reversible energy-dissipating unit is supported at least indirectly on the energy-dissipating unit with irreversible energy dissipation, and the reversible energy-dissipating unit and the energy-dissipating unit with irreversible energy dissipation each are supported by their end sides facing away from one another on one of the two transmission elements. The transmission elements are clamped against each other via at least one clamping device, especially a tension rod. Stop surface regions are provided for interaction with stop surface regions, which are provided on the vehicle side, for the introduction of draft and/or buffer forces. The reversible energy-dissipating unit is arranged supported on the first transmission element and the energy-dissipating unit with irreversible energy dissipation is arranged supported on the opposite transmission element.

To ensure compact draft/buffer apparatuses which can readily be handled in respect of the installation, the energy-dissipating units are preferably arranged coaxially with respect to each other. The latter can be introduced in a completely preassembled manner as a constructional unit into the intermediate space of draft yoke and vehicle body or component which is connected thereto and has the draft and buffer stops.

In order to provide sufficiently large supporting surfaces for the mutual support on the two energy-dissipating units and to bring the latter into operative connection with each other in a simple manner, an intermediate element is arranged between the reversible energy-dissipating unit and the energy-dissipating unit with irreversible energy dissipation, the intermediate element forming a supporting surface for the reversible energy-dissipating unit and a supporting surface for the energy-dissipating unit with irreversible energy dissipation. The intermediate element and the energy-dissipating unit with irreversible energy dissipation act as a support unit for the reversible energy-dissipating unit until a maximally permissible draft/buffer force is reached, and, when the maximally permissible draft/buffer force is exceeded, the shearing unit actuates and/or acts destructively on the energy-dissipating unit with irreversible energy dissipation. Supporting regions of different size and an offset between the supporting regions can therefore be coordinated with each other via the intermediate element. In particular, energy-dissipating units configured differently in respect of the size can be combined with each other.

For this purpose, in an advantageous embodiment, the intermediate element has a surface region on its end side directed toward the energy-dissipating unit with irreversible energy dissipation, the surface region being configured to be suitable so as to interact with the shearing unit and/or with the reversible energy-dissipating unit and with at least one surface region on the energy-dissipating unit with irreversible energy dissipation. In analogy, a further surface region is provided on the end side opposite of the latter, the further surface region serving to support the reversible energy-dissipating unit.

The reversible energy-dissipating unit has at least one or a plurality of reversible energy-dissipating members which can be connected in series or in parallel with respect to the conduction of the force flow. In a particularly advantageous embodiment, the individual energy-dissipating member is preferably configured as a polymer spring. The configuration as a polymer spring firstly permits different spring geometries. A centrally symmetrical configuration of the spring elements is preferably selected. However, in respect of the support thereof on the coupling-rod-side transmission element and the intermediate element or directly on the energy-dissipating unit with reversible energy dissipation, a geometry differing from the centrally symmetrical configuration, in particular a cross-sectional shaping different from a circular shape, can be provided at least in the end-side end regions. Elliptical, oval, ellipse-like or other cross-sectional geometries are conceivable. With an energy-dissipating member, such as, for example, with a spring element which has such a cross-sectional shaping different from a circular shape, rotation of the energy-dissipating member relative to the transmission element or intermediate element can be effectively prevented if the energy-dissipating member lies flush. In a particularly advantageous embodiment, the intermediate element is configured at least on one end side as a cone. This permits an optimized introduction of force in interaction with a destructive energy-dissipating element in the form of a deformation tube.

In an advantageous embodiment, the energy-dissipating unit with irreversible energy dissipation comprises at least one destructive deformation element. With regard to the arrangement and configuration of the latter, there are a plurality of possibilities. The individual destructive deformation element is preferably configured as an element from the following group of elements: a deformation body, a deformation tube or a honeycomb structure. A deformation body here is a three-dimensional structure of any desired contour. This affords the advantage of being able to adapt the destructively deformable element to any desired connection geometries and fitting situations and also to the load situation.

In an embodiment as a deformation tube, the latter is configured at least over a partial region of its axial extent as a hollow profile element, the cross section of the hollow profile being embodied as a tube, box profile or polygon.

The embodiment as a tube in conjunction with the embodiment of the reversible energy-dissipating unit as a spring unit affords the advantage of arranging the two in a manner oriented coaxially with respect to each other in a housing. The response force and the desired deformation behavior can be set here as a function of the geometry of the cross-sectional area, wall thickness, extent in the longitudinal direction (length) and of the material used.

The individual energy-dissipating units are preferably arranged in a housing, wherein the housing is preferably of multi-part configuration. As a result, an embodiment which is encapsulated in relation to environmental influences in the fitted situation can be provided, the embodiment being present as a preassembled unit which can be handled independently, and can be fitted in this form.

The stop regions for the introduction of draft forces and/or buffer forces to the vehicle body are preferably arranged on a guide which is connectable to the vehicle body, the guide preferably being formed by a profile element.

The energy-dissipating device according to the invention comprising two transmission elements which are clamped against each other in the longitudinal direction of the energy-dissipating device via at least one clamping unit, in particular a tension rod, and at least one reversible energy-dissipating unit arranged between the transmission elements comprises the fact that the energy-dissipating device furthermore comprises an energy-dissipating unit with irreversible energy dissipation, wherein the reversible energy-dissipating unit and the energy-dissipating unit with irreversible energy dissipation are at least partially arranged next to each other or are at least partially arranged one downstream of the other, wherein the reversible energy-dissipating unit is at least indirectly supported on the energy-dissipating unit with irreversible energy dissipation, and the reversible energy-dissipating unit and the energy-dissipating unit with irreversible energy dissipation are each supported by their end sides facing away from one another on one of the two transmission elements.

The energy-dissipating device combines advantages of reversible and irreversible energy dissipation in a minimum construction space in a compact structural unit which can be premanufactured.

In order to provide particularly compact and simply constructed energy-dissipating devices, the reversible energy-dissipating unit and the energy-dissipating unit with irreversible energy dissipation are preferably arranged coaxially with respect to each other.

In order to obtain a precisely defined response of the destructive element, a shearing unit is preferably provided between the reversible energy-dissipating unit and the energy-dissipating unit with irreversible energy dissipation, the shearing unit being configured and arranged in such a manner as to respond when a maximally permissible draft/buffer force is exceeded and to permit a destructive effect on the energy-dissipating unit with irreversible energy dissipation.

Relatively large supporting surfaces and the allocation with respect to one another and optionally a compensation of the offset between reversible energy-dissipating unit and the energy-dissipating unit with irreversible energy dissipation are advantageously achieved by the arrangement of an intermediate element therebetween, the intermediate element forming a supporting surface for the reversible energy-dissipating unit and a supporting surface for the energy-dissipating unit with irreversible energy dissipation, the intermediate element and the energy-dissipating unit with irreversible energy dissipation acting as a support unit for the reversible energy-dissipating unit until a maximally permissible draft/buffer force is reached, and, only when the maximally permissible draft/buffer force is exceeded, a shearing unit actuates and/or acts destructively on the energy-dissipating unit with irreversible energy dissipation. According to a particularly advantageous embodiment, the intermediate element is embodied for this purpose as a cone.

With regard to the advantages of the configuration of the reversible energy-dissipating unit with at least one or a plurality of reversible energy-dissipating members which can be connected in series or in parallel in respect of the conduction of the force flow, and also the configuration of the energy-dissipating unit with irreversible energy dissipation, reference is made to the advantages already mentioned in conjunction with the draft/buffer apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
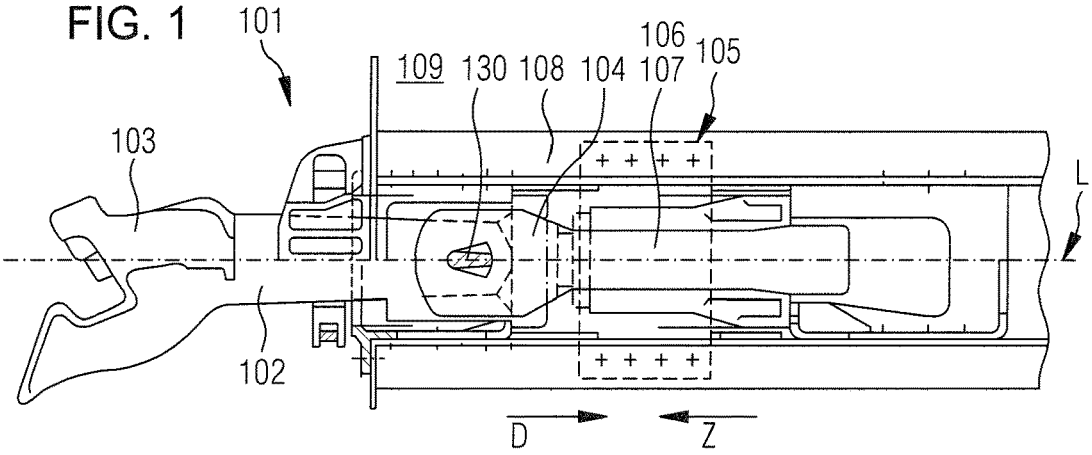
FIG. 1 shows a coupling apparatus according to the prior art.

FIG. 1 shows by way of example a configuration of a central buffer coupling 101 known from the prior art. The theoretical longitudinal axis L of the central buffer coupling 101 coincides in the mounted position with the longitudinal direction of the railway car. The directions of the draft and buffer loads, which occur during operation, on the coupling rod 102 are denoted by Z for the draft direction and by D for the buffer direction.

The central buffer coupling 101 illustrated is, by way of example, a central buffer coupling of the type SA-3, in which a coupling rod 102 is connected via a key 130 to a draft yoke 104 which is connected to the underframe 109 of a railway car body. On the end facing away from the railway car body, the coupling rod 102 is coupled to a coupling head 103 either directly or, in the case of a subdivided coupling rod 102, via further intermediate elements.

A draft and buffer apparatus 105 is arranged between the coupling rod 102, in particular that end region of the coupling rod 102 which is directed toward the car body, and the car body. The draft and buffer apparatus comprises an energy-dissipating device 106 in the form of a spring apparatus. The energy-dissipating device 106 has at least one energy-dissipating unit 107, especially at least one reversible energy-dissipating element. The use of an energy-dissipating device comprising at least one destructive energy-dissipating element in the form of a deformation tube is also conceivable. The arrangement is realized here within the extent of the draft yoke 104 between coupling rod 102 and support of the latter on stop surface regions, which are provided therefor and are effective in the draft or buffer direction, on the underframe 109 of the railway car body.

Figure 2A:
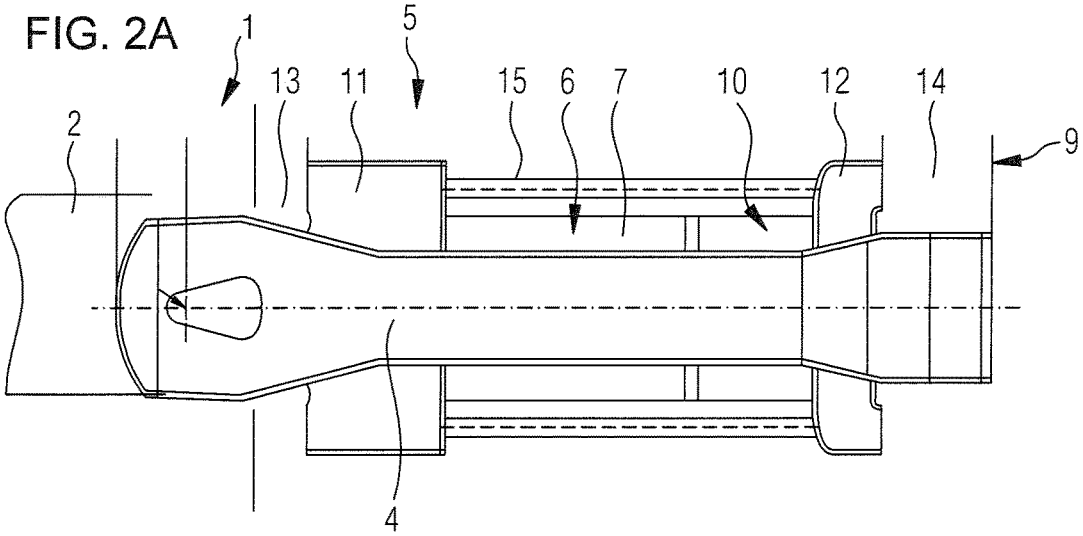
FIGS. 2A and 2B show two views of a draft/buffer apparatus configured according to the invention, with reference to a cutout from a coupling arrangement.
Figure 2B:
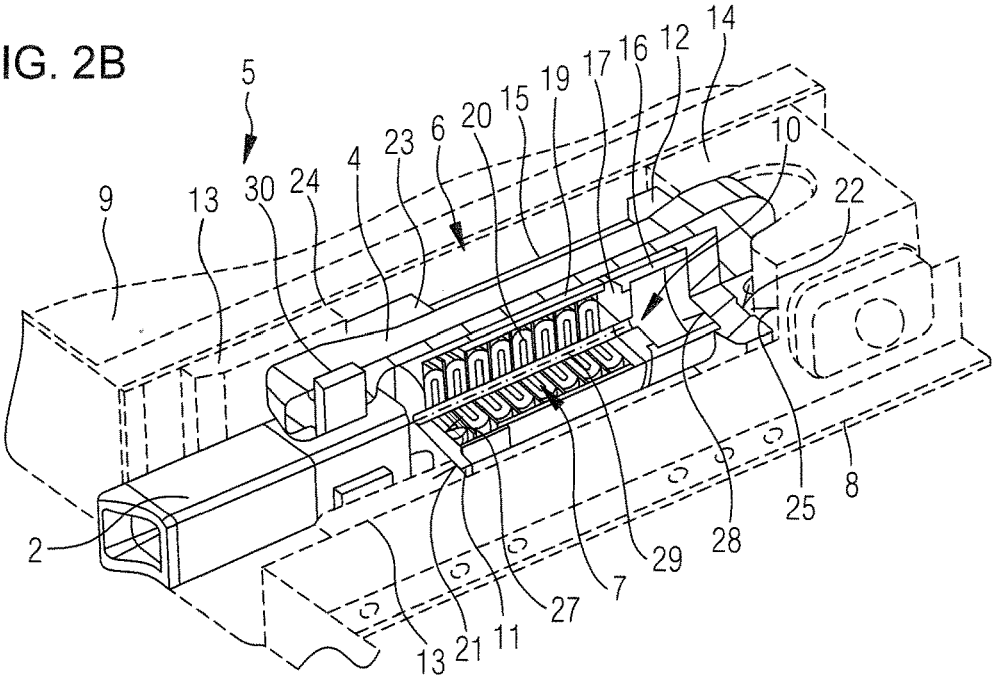

FIGS. 2A and 2B show different views of the linkage according to the invention of a coupling rod 2 via a draft yoke 4 on the underframe 9 of a railway car body with reference to a cutout from a central buffer coupling 1.

FIG. 2A shows the essential components of the draft and buffer apparatus 5 configured according to the invention, in a plan view, while FIG. 2B provides a perspective view. Only the essential elements of the draft and buffer apparatus 5 are shown. The latter is configured in such a manner that the force flow of the draft/buffer forces transmitted by the coupling rod 2 is conducted entirely through the energy-dissipating device 6. For this purpose, the energy-dissipating device 6 comprises a reversible energy-dissipating unit 7, comprising at least one reversible energy-dissipating member and an energy-dissipating unit 10 with irreversible energy dissipation, called irreversible energy-dissipating unit 10 for short below. Reversible and irreversible energy-dissipating units 7 and 10 are arranged in series and are disposed one behind the other, as viewed in the longitudinal direction of the draft/buffer apparatus 5.

The arrangement is provided between two transmission elements 11 and 12. The transmission element 11 is arranged on the coupling-rod end as seen in the longitudinal direction of the coupling longitudinal axis L, especially as a first stop plate. The transmission element 12 is arranged at the railway car body and is especially a second stop plate. The first and second stop plates are connected to each other via at least one tension rod 15, preferably by a plurality of tension rods 15, and under the pretensioning of the reversible energy-dissipating unit 7. The tension rods or the individual tension rod 15 are preferably arranged around the outer circumference of the individual energy-dissipating units 7 and 10, and especially in spaced relationship thereto. It would also be conceivable to pass the tension rods through the energy-dissipating units and to use them at the same time as a guide, especially for the spring elements.

The transmission elements 11, 12, at their respective ends, each have supporting regions 21 and 22 directed away from one another. These supporting regions are especially in the form of supporting surfaces or surface regions which can be brought to coact with corresponding stop regions, especially stops 13, 14 on the railway car body, and especially underframe 9 thereof. The transmission elements 11, 12 are preferably of disc-shape or plate-like configuration. However, the transmission elements 11, 12 may also be configured in a functional concentration as housing components which are preferably configured to at least partially surround at least one partial region of one of the energy-dissipating units 7 or 10 in the circumferential direction. The stops 13 and 14 can be mounted directly on the underframe 9 or else preferably on a longitudinal member 8. The longitudinal member 8 is preferably connected to the underframe 9 to the railway car body. The stops 13 and 14 on the longitudinal member 8 act for the draft yoke 4 as a draft or buffer stop. The stop 13 which, in the embodiment shown, is arranged in the longitudinal direction L at the coupling-rod end acts as a draft stop whereas the stop 14 acts as a buffer stop. The stops 13 and 14 have respective support regions, especially support surface regions 24 and 25, interacting with the energy-dissipating device 6 and especially with the transmission elements 11 and 12.

The draft and buffer apparatus 5 is so configured that the force flow of the buffer forces, which are transmitted by the coupling rod 2, is transmitted by the coupling-rod end or first transmission element 11, which is forward in longitudinal direction L, via the energy-dissipating unit 7 to the end face of the second transmission element 12 with this end face lying opposite the first transmission element 11.

The draft forces are transmitted by the coupling rod 2 and the draft yoke 4. The force flow of these draft forces takes place from the rearward transmission element 12 via the energy-dissipating device 6 to the end face, which lies opposite to the railway car end transmission element 12, on the first transmission element 11 and from there to the first stop 13 via the coaction of the support regions 21 and 24 on the first transmission element 11 and the draft stop 13.

The draft yoke 4 is connected to the end region of the coupling rod 2 that is oriented to the railway car end. Here, connection is with a key 30 oriented perpendicularly to the longitudinal axis L. The connection can be with or free from a possibility of relative movement between coupling rod 2 and draft yoke 4.

The individual energy-dissipating units 7 and 10 lie here with their respective end faces, which face toward corresponding ones of the transmission elements 11, 12, preferably completely against correspondingly configured surface regions 27 and 28 on the transmission elements 11, 12.

The reversible energy-dissipating unit 7 comprises at least one energy-dissipating member. In an especially advantageous embodiment, the latter is configured as a spring element, especially a polymer spring. The spring element is preferably guided on a guide 29 provided between an intermediate element 17 and transmission element 11. The guide 29 is especially a guide bolt. The cross-sectional geometry of the spring apparatus can be selected as desired. Circular cross-sectional geometries are preferably selected or those with a small deviation from the circular shape.

The reversible energy-dissipating unit 7 is arranged between the first transmission element 11 and the irreversible energy-dissipating unit 10. In the embodiment shown, the irreversible energy-dissipating unit 10 comprises an irreversible deformation element in the form of a deformation tube 16. The latter should be understood as meaning an element which at least plastically deforms when subjected to a force which is greater than the maximally permissible force.

The energy-dissipating units 7 and 10 are arranged coaxially with respect to each other and are preferably arranged next to each other. An intermediate element 17 can be optionally provided and is disposed between the units 7 and 10 as shown. The reversible energy-dissipating unit 7 is especially a spring unit and is supported via the intermediate element 17 on the deformation tube. For this purpose, the intermediate element 17 has a surface region on the end face directed towards the transmission element 11, which surface region serves as a support region for the spring unit, in particular, the end region on the vehicle-body side in the built-in or mounted position. The spring unit is preferably supported over the full area on the intermediate element 17. The deformation tube 16 is supported on the end face opposite the coupling-rod side end face. The deformation tube preferably has a stop surface for interaction with the counter element which is of inclined configuration, as viewed in the longitudinal direction of the energy-dissipating element. In the coupling-rod-side end region, the deformation tube has a wall region, the end surface of which comes into contact flush with the intermediate element 17. The two surface regions, which are operatively connected to each other, that is, lie against each other, especially of intermediate element 17 and deformation tube 16, are preferably of inclined configuration in the longitudinal direction, in the form of conical surfaces in an embodiment with a circular or annular cross section.

A shearing unit 18 is arranged downstream in the longitudinal direction of that surface region of the deformation tube 16 which is provided for bearing against the intermediate element 17. The shearing unit 18 is in the form of a projection arranged on the inner circumference of the deformation tube 16. There are a plurality of possibilities with regard to the specific configuration of the shearing unit. In an especially advantageous manner, the individual stop surface is formed by a projection which is formed on the energy-dissipating device or is connected thereto. The single-part configuration affords the advantage of simple manufacturing.

A uniform introduction of load is ensured by the fact that the individual stop surface is of closed configuration, as viewed in the circumferential direction of the energy-dissipating device. In the event of an overload, shearing off of the projection and expansion of the deformation tube 16 are ensured by this configuration.

The energy-dissipating unit 7 is surrounded by a housing part 19. The housing part 19 surrounds a partial region of the energy-dissipating unit 7, especially the spring unit, as viewed in the longitudinal direction, in the circumferential direction with the formation of a spacing which describes a cavity and is at least partially filled during deformation of the spring unit. A further housing part is formed here directly on the transmission element 11 and extends, as viewed in the longitudinal direction, over a partial region of the extent of the energy-dissipating unit 7, especially of the spring unit. An at least partial overlapping of the further housing part and of the housing part 19 is possible.

Means for guiding the transmission elements 11, 12 are preferably integrated in the end faces thereof that are directed toward the energy-dissipating units 7 and 10. The means may be recesses or projections which fix the energy-dissipating units transversely with respect to the longitudinal direction in respect of their position in relation to the transmission element, that is avoid slipping or displacement transversely with respect to the longitudinal direction.

Figure 3:
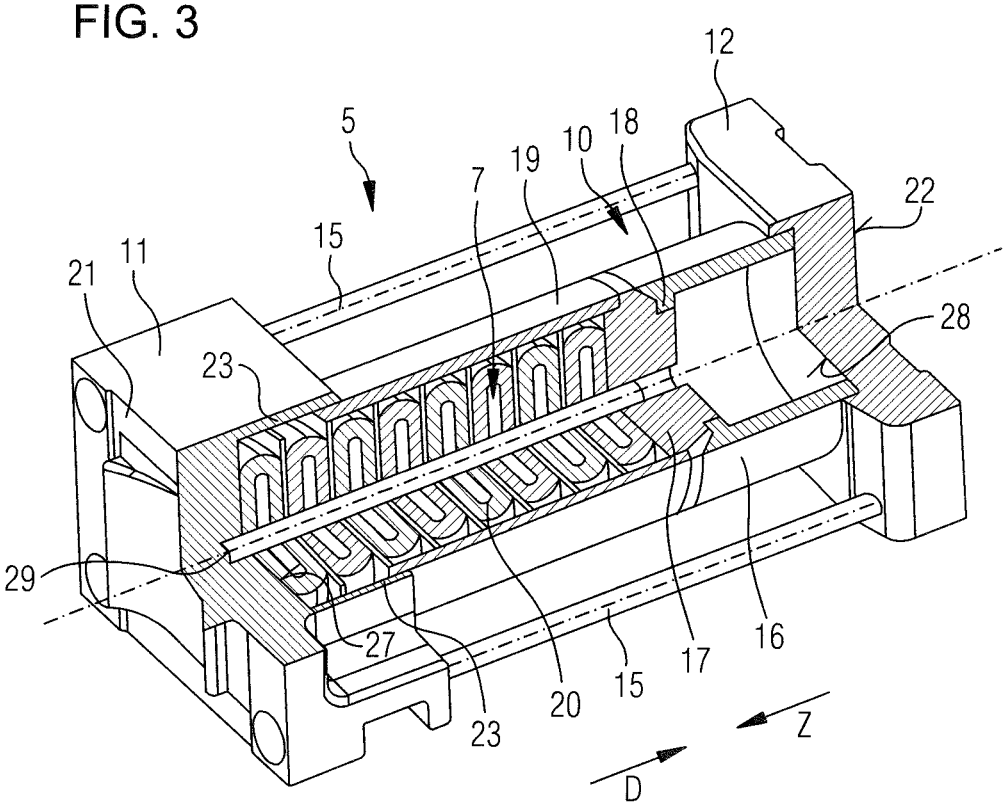
FIGS. 3 and 4 show the energy-dissipating apparatus.

FIG. 3 shows by way of example a particularly advantageous embodiment of the draft and buffer apparatus 5 with the energy-dissipating device 6. The draft and buffer apparatus comprises two transmission elements 11, 12 which are provided for interaction with stops 13, 14, which are arranged on the railway car side, the transmission elements being arranged spaced apart in the axial direction with the intermediate arrangement of the energy-dissipating units 7, 10 and clamped against each other via tension rods 15. The stops 13, 14 are provided especially on the underframe 9 and have support surfaces or support surface regions 24 and 25 for interaction with the transmission elements 11, 12. The transmission elements 11, 12 are preferably of plate-like or disc-shaped configuration, wherein the support regions 21 and 22 are formed for interaction with the stops 13, 14, which are arranged on the railway car side, of flat regions and surface regions. Furthermore, the intermediate element 17 and the shearing unit 18 can be seen in the partial section.

Figure 4:
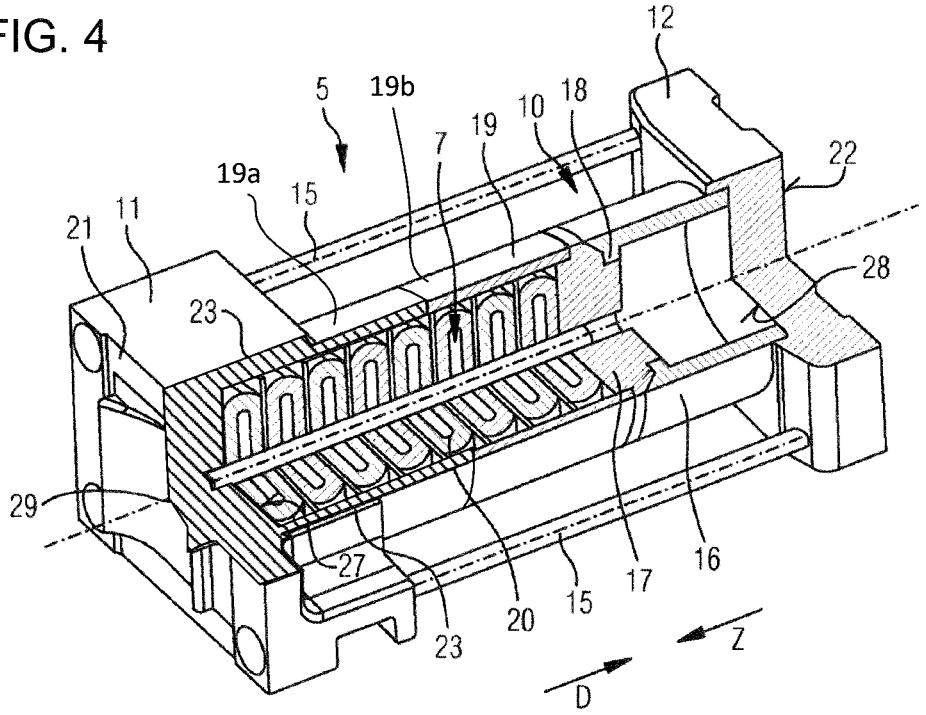

As shown in FIGS. 3 and 4, the intermediate element 17 is configured as a cone having an end face for supporting the reversible energy-dissipating unit 7 and a stop surface coacting with the irreversible energy-dissipating unit 10.

FIGS. 3 and 4 also show an energy-dissipating unit 7 comprising a spring packet. Embodiments with a plurality of spring units which are functionally connected in series are also possible.

The housing 19 is preferably of multi-part configuration as shown in FIG. 4 which shows the housing including a plurality of parts 19*a*, 19*b* which are at least in part integral with the transmission elements 11, 12.

Figure 5:
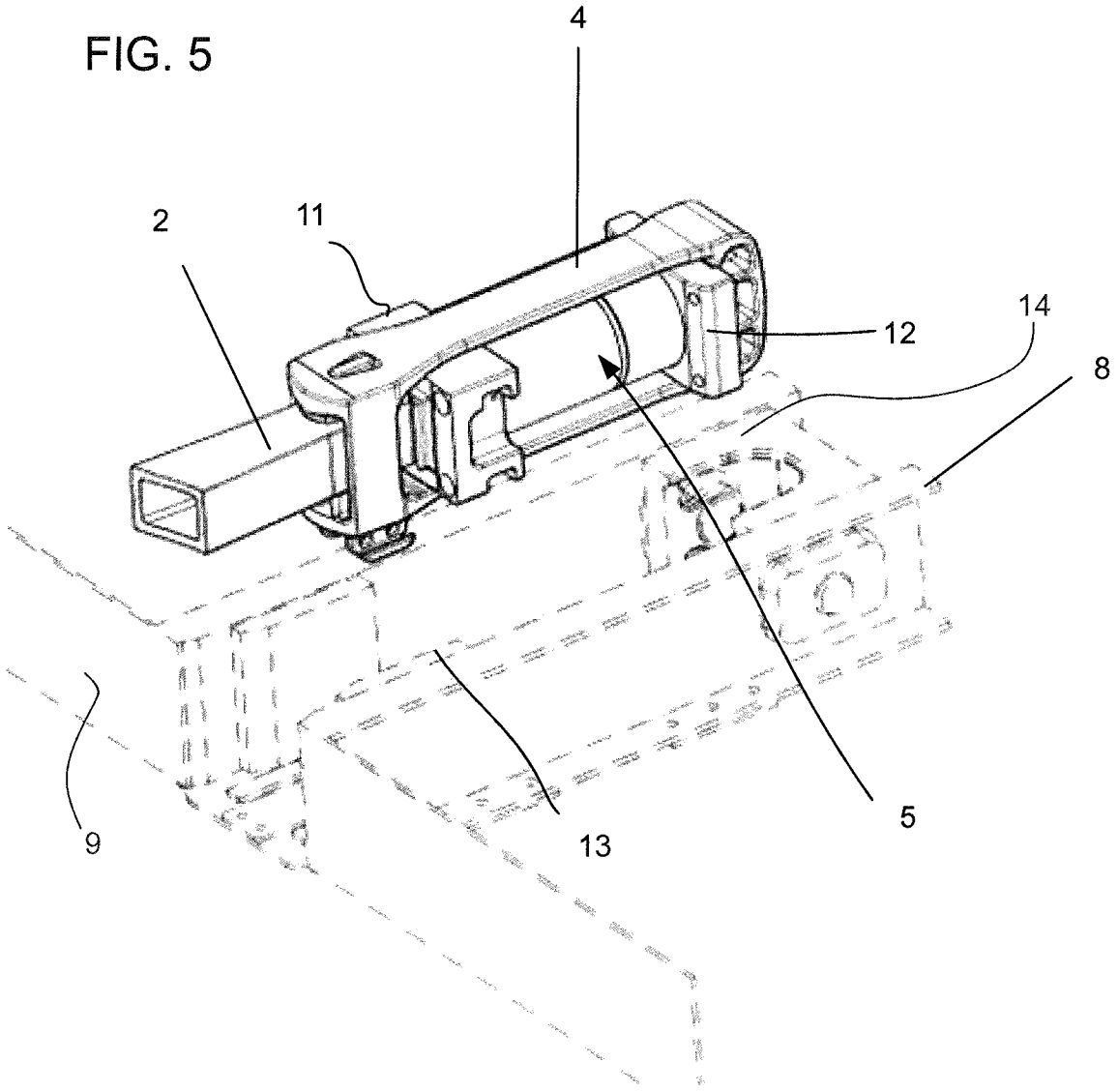
FIG. 5 shows an exploded perspective view of the draft and buffer apparatus and, in phantom outline, the longitudinal member and underframe of a railway car body.

FIG. 5 is an exploded perspective view which shows the draft and buffer apparatus 5 and, in phantom outline, the longitudinal member 8 and the underframe 9. Here, too, the stops 13 and 14 are shown which coact with the transmission elements 11 and 12, respectively, as described above.

It is understood that the foregoing description is that of the preferred embodiments of the invention and that various changes and modifications may be made thereto without departing from the spirit and scope of the invention as defined in the appended claims.

LIST OF REFERENCE CHARACTERS

1 Central buffer coupling
2 Coupling rod
3 Coupling head
4 Draft yoke
5 Draft/buffer apparatus
6 Energy-dissipating device
7 Reversible energy-dissipating unit
8 Longitudinal member
9 Underframe
10 Irreversible energy-dissipating unit
11 Draft-side transmission element, especially a first stop plate
12 Buffer-side transmission element, especially a second stop plate
13 Stop, in particular draft stop
14 Stop, in particular buffer stop
15 Tension rod
16 Deformation tube
17 Intermediate element, cone
18 Shearing unit
19 Housing
19*a*, 19*b* Housing parts
20 Spring unit, spring element
21 Support region, in particular surface region on the draft-side transmission element for contact against the draft stop
22 Support region, in particular surface region on the buffer-side transmission element for contact against the buffer stop
23 Housing part; expanded region
24 Support surface, in particular support surface region on the draft stop
25 Support surface, in particular support surface region on the buffer stop
27 Supporting surface, in particular support surface region on the draft-side transmission element for energy-dissipating unit 7
28 Support surface, in particular support surface region on the buffer-side transmission element for irreversible energy dissipation
29 Guide
30 Key
101 Central buffer coupling (prior art)
102 Coupling rod (prior art)
103 Coupling head (prior art)
104 Draft yoke (prior art)
105 Draft/buffer apparatus (prior art)
106 Energy-dissipating device (prior art)
107 Reversible energy-dissipating unit (prior art)
109 Underframe
130 Key (prior art)
D Buffer direction
L Longitudinal axis
Z Draft direction

What is claimed is:

1. A draft and buffer apparatus for a track-guided vehicle including a rail vehicle, the vehicle defining a longitudinal direction and including a vehicle body and the apparatus comprising:

a coupling rod;

a draft yoke for connecting said coupling rod to said vehicle body;

said coupling rod being configured to transmit therefrom draft and buffer forces, which occur during travel of the vehicle, to said vehicle body;

said coupling rod having a vehicle end region;

an energy-dissipating device arranged between said vehicle end region of said coupling rod and said vehicle body for receiving said draft and buffer forces;

first and second stops for introducing draft forces and/or buffer forces to said vehicle body or to a component connected at least indirectly to said vehicle body;

said energy-dissipating device including a reversible energy-dissipating unit;

said energy-dissipating device being configured so as to cause the force flow of the buffer loads transmitted thereto from said coupling rod and the force flow of the draft forces transmitted via said draft yoke thereto to be conducted through said energy-dissipating device and to be transmitted via said stops to said vehicle body or said component;

said coupling rod defining a longitudinal direction;

said energy-dissipating device, when mounted and viewed in said longitudinal direction, having a forward transmission element at the vehicle end region of said coupling rod and a rearward transmission element at the vehicle;

said reversible energy-dissipating unit being mounted pretensioned between said forward and rearward transmission elements;

said energy-dissipating device further including an irreversible energy-dissipating unit providing irreversible energy dissipation;

said irreversible energy-dissipating unit having an end face directed toward said reversible energy-dissipating unit and being disposed between said reversible energy-dissipating unit and said rearward transmission element so as to be axially aligned with said reversible energy-dissipating unit;

an intermediate element interposed between said energy-dissipating units for transmitting said forces in said longitudinal direction to said irreversible energy-dissipating unit directly at said end face thereof;

a tensioning arrangement for bracing said forward and rearward transmission elements with respect to each other; and, said energy-dissipation device being mounted within the axial extent of said draft yoke when viewed in said longitudinal direction of said vehicle.

2. The draft and buffer apparatus of claim 1, wherein:

said irreversible energy-dissipating unit is connected in series with said reversible energy-dissipating unit; and, said irreversible energy-dissipating unit is configured to irreversibly deform or destruct when a predefined maximum draft/buffer force is exceeded.

3. The draft and buffer apparatus of claim 1, wherein said intermediate element is mounted between said reversible energy-dissipating unit and said irreversible energy-dissipating unit;

said irreversible energy-dissipating unit including a shearing unit formed thereon and bearing against said intermediate element; and, said shearing unit is configured and arranged to impart a destructive action to said irreversible energy-dissipating unit in response to said draft/buffer force exceeding a maximum permissible draft/buffer force transmitted to said shearing unit via said intermediate element.

4. A draft and buffer apparatus for a track-guided vehicle including a rail vehicle, the vehicle defining a longitudinal direction and including a vehicle body and the apparatus comprising:

a coupling rod;

a draft yoke for connecting said coupling rod to said vehicle body;

said coupling rod being configured to transmit therefrom draft and buffer forces, which occur during travel of the vehicle, to said vehicle body;

said coupling rod having a vehicle end region;

an energy-dissipating device arranged between said vehicle end region of said coupling rod and said vehicle body for receiving said draft and buffer forces;

first and second stops for introducing draft forces and/or buffer forces to said vehicle body or to a component connected at least indirectly to said vehicle body;

said energy-dissipating device including a reversible energy-dissipating unit;

said energy-dissipating device being configured so as to cause the force flow of the buffer loads transmitted thereto from said coupling rod and the force flow of the draft forces transmitted via said draft yoke thereto to be conducted through said energy-dissipating device and to be transmitted via said stops to said vehicle body or said component;

said coupling rod defining a longitudinal direction;

said energy-dissipating device, when mounted and viewed in said longitudinal direction, having a forward transmission element at the vehicle end region of said coupling rod and a rearward transmission element at the vehicle;

said reversible energy-dissipating unit being mounted pretensioned between said forward and rearward transmission elements;

said energy-dissipating device further including an irreversible energy-dissipating unit providing irreversible energy dissipation;

said energy-dissipation device being mounted within the axial extent of said draft yoke when viewed in said longitudinal direction of said vehicle;

said irreversible energy-dissipating unit being mounted at least partially next to said reversible energy-dissipating unit or at least partially downstream thereof as viewed in the longitudinal direction of the vehicle;

said reversible energy-dissipating unit being at least indirectly supported against said irreversible energy-dissipating unit;

said reversible energy-dissipating unit and said irreversible energy-dissipating unit having respective end faces which are directed away from each other;

said reversible energy-dissipating unit and said irreversible energy-dissipating unit being supported with said respective end faces against corresponding ones of said transmission elements;

said forward and rearward transmission elements having respective impact surfaces;

said stops having respective impact surfaces for coacting with corresponding ones of said impact surfaces of said transmission elements to introduce said draft forces and/or buffer forces;

said reversible energy-dissipating unit being supported against said forward transmission element and said irreversible energy-dissipating unit being supported against said rearward transmission element; and, said draft and buffer apparatus further comprising tension rods for tensioning said forward and rearward transmission elements with respect to each other.

5. The draft and buffer apparatus of claim 1, wherein said reversible energy-dissipating unit and said irreversible energy-dissipating unit are mounted to be mutually coaxial and between said forward and rearward transmission elements.

6. The draft and buffer apparatus of claim 3, further comprising:

said intermediate element having first and second support surfaces for respective ones of said reversible energy-dissipating unit and said irreversible energy-dissipating unit; and, said intermediate element and said irreversible energy-dissipating unit conjointly operating as a support unit for said reversible energy-dissipating unit up to a maximum permissible draft/buffer force being reached and, when said maximum permissible draft/buffer force is exceeded, said shearing unit acts upon said irreversible energy-dissipating unit by pressing and/or destroying the latter.

7. The draft and buffer apparatus of claim 6, wherein said second support surface of said intermediate element defines a surface region configured to be suitable so as to interact with said shearing unit and/or with at least one surface region on said irreversible energy-dissipating unit.

8. The draft and buffer apparatus of claim 7, wherein said intermediate element is configured as a cone having an end face for supporting said reversible energy-dissipating unit and a stop surface coacting with said irreversible energy-dissipating unit.

9. The draft and buffer apparatus of claim 1, wherein said reversible energy-dissipating unit includes at least one or a plurality of reversible energy-dissipating elements which are connected in series or in parallel with respect to the conduction of said force flow.

10. The draft and buffer apparatus of claim 9, wherein said reversible energy-dissipating unit includes at least one polymer spring.

11. The draft and buffer apparatus of claim 1, wherein said irreversible energy-dissipating unit includes at least one destructive deformation element.

12. The draft and buffer apparatus of claim 11, wherein said destructive deformation element is configured as one of: a deformation body; a deformation tube; or, a honeycomb structure.

13. The draft and buffer apparatus of claim 12, wherein said deformation tube is configured over at least a portion of its axial extent as a hollow profile element; and, said hollow profile element has a cross section configured as one of the following: tube; box; or, polygon.

14. The draft and buffer apparatus of claim 1, further comprising a housing at least partially enclosing said energy-dissipating device.

15. The draft and buffer apparatus of claim 1, further comprising a housing enclosing all of said energy-dissipating device.

16. The draft and buffer apparatus of claim 14, wherein said housing includes a plurality of parts which are at least in part integral with said transmission elements.

17. The draft and buffer apparatus of claim 1, wherein said stops are arranged on a guide connectable to said vehicle body.

18. The draft and buffer apparatus of claim 17, wherein said guide is configured as a profile element.

19. An energy-dissipating device defining a longitudinal direction and comprising:

first and second transmission elements arranged in said longitudinal direction;

a tensioning arrangement for bracing said first and second transmission elements with respect to each other;

a reversible energy-dissipating unit mounted between said first and second transmission elements;

an irreversible energy-dissipating unit providing irreversible energy dissipation;

said reversible energy-dissipating unit and said irreversible energy-dissipating unit being arranged at least partially next to each other or being at least partially arranged one downstream of the other;

said reversible energy-dissipating unit being at least indirectly supported on said irreversible energy-dissipating unit;

said reversible energy-dissipating unit and said irreversible energy-dissipating unit having respective end faces directed away from each other; and, said reversible energy-dissipating unit and said irreversible energy-dissipating unit being supported with said respective end faces against corresponding ones of said first and second transmission elements.

20. The energy-dissipating device of claim 19, wherein said reversible energy-dissipating unit and said irreversible energy-dissipating unit are mounted to be coaxial to each other.

21. The energy-dissipating device of claim 20, further comprising:

a shearing unit disposed between said reversible energy-dissipating unit and said irreversible energy-dissipating unit; and, said shearing unit being configured and mounted to permit imparting a destructive action to said irreversible energy-dissipating unit in response to a maximum draft/buffer force exceeding a maximum permissible draft/buffer force.

22. The energy-dissipating device of claim 21, further comprising:

an intermediate element disposed between said reversible energy-dissipating unit and said irreversible energy-dissipating unit and having first and second support surfaces for respective ones of said reversible energy-dissipating unit and said irreversible energy-dissipating unit; and, said intermediate element and said irreversible energy-dissipating unit conjointly operating as a support unit for said reversible energy-dissipating unit up to a maximum permissible draft/buffer force being reached and, when said maximum permissible draft/buffer force is exceeded, said shearing unit acts upon said irreversible energy-dissipating unit by pressing and/or destroying the latter.

23. The energy-dissipating device of claim 22, wherein said intermediate element is configured as a cone having an end face for supporting said reversible energy-dissipating unit and a stop surface coacting with said irreversible energy-dissipating unit.

24. The energy-dissipating device of claim 19, wherein said reversible energy-dissipating unit includes at least one or a plurality of reversible energy-dissipating elements which are connected in series or in parallel with respect to the conduction of a force flow;

said irreversible energy-dissipating unit includes at least one destructive deformation element; and, said destructive deformation element is configured as one of: a deformation body; a deformation tube; or, a honeycomb structure.

25. The energy-dissipating device of claim 19, further comprising a housing at least partially enclosing said energy-dissipating device.

26. The energy-dissipating device of claim 19, further comprising a housing enclosing all of said energy-dissipating device.

27. The energy-dissipating device of claim 26, wherein said housing includes a plurality of parts which are at least in part integral with said transmission elements.

28. A draft and buffer apparatus for a track-guided vehicle including a rail vehicle, the vehicle defining a longitudinal direction and including a vehicle body and the apparatus comprising:

a coupling rod;

a draft yoke for connecting said coupling rod to said vehicle body;

said coupling rod being configured to transmit therefrom draft and buffer forces, which occur during travel of the vehicle, to said vehicle body;

said coupling rod having a vehicle end region;

an energy-dissipating device arranged between said vehicle end region of said coupling rod and said vehicle body for receiving said draft and buffer forces;

first and second stops for introducing draft forces and/or buffer forces to said vehicle body or to a component connected at least indirectly to said vehicle body;

said energy-dissipating device including a reversible energy-dissipating unit;

said energy-dissipating device being configured so as to cause the force flow of the buffer loads transmitted thereto from said coupling rod and the force flow of the draft forces transmitted via said draft yoke thereto to be conducted through said energy-dissipating device and to be transmitted via said stops to said vehicle body or said component;

said coupling rod defining a longitudinal direction;

said energy-dissipating device, when mounted and viewed in said longitudinal direction, having a forward transmission element at the vehicle end region of said coupling rod and a rearward transmission element at the vehicle;

said reversible energy-dissipating unit being mounted pretensioned between said forward and rearward transmission elements;

said energy-dissipating device further including an irreversible energy-dissipating unit providing irreversible energy dissipation;

said energy-dissipation device being mounted within the axial extent of said draft yoke when viewed in said longitudinal direction of said vehicle;

said irreversible energy-dissipating unit being connected in series with said reversible energy-dissipating unit;

said irreversible energy-dissipating unit being configured to irreversibly deform or destruct when a predefined maximum draft/buffer force is exceeded;

a shearing unit mounted between said reversible energy-dissipating unit and said irreversible energy-dissipating unit;

said shearing unit being configured and mounted to impart a destructive action to said irreversible energy-dissipating unit in response to said draft/buffer force exceeding a maximum permissible draft/buffer force;

said irreversible energy-dissipating unit being mounted at least partially next to said reversible energy-dissipating unit or at least partially downstream thereof as viewed in the longitudinal direction of the vehicle;

said reversible energy-dissipating unit being at least indirectly supported against said irreversible energy-dissipating unit;

said reversible energy-dissipating unit and said irreversible energy-dissipating unit having respective end faces which are directed away from each other;

said reversible energy-dissipating unit and said irreversible energy-dissipating unit being supported with said respective end faces against corresponding ones of said transmission elements;

said forward and rearward transmission elements having respective impact surfaces;

said stops having respective impact surfaces for coacting with corresponding ones of said impact surfaces of said transmission elements to introduce said draft forces and/or buffer forces;

said reversible energy-dissipating unit being supported against said forward transmission element and said irreversible energy-dissipating unit being supported against said rearward transmission element; and, said draft and buffer apparatus further including tension rods for tensioning said forward and rearward transmission elements with respect to each other.

29. The draft and buffer apparatus of claim 28, wherein said reversible energy-dissipating unit and said irreversible energy-dissipating unit are mounted to be mutually coaxial and between said forward and rearward transmission elements.

30. The draft and buffer apparatus of claim 29, further comprising:

an intermediate element disposed between said reversible energy-dissipating unit and said irreversible energy-dissipating unit and having first and second support surfaces for respective ones of said reversible energy-dissipating unit and said irreversible energy-dissipating unit; and, said intermediate element and said irreversible energy-dissipating unit conjointly operating as a support unit for said reversible energy-dissipating unit up to a maximum permissible draft/buffer force being reached and, when said maximum permissible draft/buffer force is exceeded, said shearing unit acts upon said irreversible energy-dissipating unit by pressing and/or destroying the latter.

31. The draft and buffer apparatus of claim 30, wherein said intermediate element is configured as a cone having an end face for supporting said reversible energy-dissipating unit and a stop surface coacting with said irreversible energy-dissipating unit.

32. The draft and buffer apparatus of claim 1, wherein said end face of said irreversible energy-dissipating unit is an annular end face having a conical portion and a recessed flat portion defining a plane perpendicular to said longitudinal direction; and, said intermediate element has an end face complementary to said end face of said irreversible energy-dissipating unit for coacting therewith to transmit said forces.

* * * * *